US009616266B2

(12) United States Patent
Schröer

(10) Patent No.: US 9,616,266 B2
(45) Date of Patent: Apr. 11, 2017

(54) APPARATUS FOR PHYSICAL EXERCISE

(75) Inventor: Johannes Dominicus Schröer, Deventer (NL)

(73) Assignee: Onder de Linden B.V., Deventer (NL)

( * ) Notice: Subject to any disclaimer, the term of this patent is extended or adjusted under 35 U.S.C. 154(b) by 662 days.

(21) Appl. No.: 13/989,018

(22) PCT Filed: Nov. 23, 2011

(86) PCT No.: PCT/NL2011/050796

§ 371 (c)(1),
(2), (4) Date: Jul. 30, 2013

(87) PCT Pub. No.: WO2012/091551

PCT Pub. Date: Jul. 5, 2012

(65) Prior Publication Data

US 2013/0303341 A1 Nov. 14, 2013

(30) Foreign Application Priority Data

Nov. 29, 2010 (NL) ..... 2005775

(51) Int. Cl.
*A63B 21/005* (2006.01)
*A63B 21/00* (2006.01)
(Continued)

(52) U.S. Cl.
CPC ..... *A63B 21/00* (2013.01); *A63B 21/0058* (2013.01); *A63B 21/4035* (2015.10);
(Continued)

(58) Field of Classification Search
CPC ..... A63B 21/0058; A63B 21/0059; A63B 21/1492; A63B 21/4047; A63B 21/4049;
(Continued)

(56) References Cited

U.S. PATENT DOCUMENTS 6,267,709 B1 * 7/2001 Jacques et al. ..... 482/8

FOREIGN PATENT DOCUMENTS

DE 196 53 862 A1 6/1998
EP 1584355 * 10/2005 ..... A63B 21/005
(Continued)

OTHER PUBLICATIONS

Written Opinion issued in International Application No. PCT/NL2011/050796.

*Primary Examiner* — Loan H Thanh
*Assistant Examiner* — Rae Fischer
(74) *Attorney, Agent, or Firm* — Michael Best & Friedrich, LLP

(57) ABSTRACT

Physical training apparatus, at least comprising a frame, a load which is to be gripped by a user and which is provided as a load shaft arranged on the frame and rotatable through a determined rotation angle, wherein an electric motor is provided to produce a torque exerted on the load shaft, the electric motor being coupled by means of first coupling means to a reaction shaft, which reaction shaft is coupled by means of second coupling means to the load shaft, wherein the rotation angle of the load shaft is limited to a value of less than 360°, and the second coupling means are adapted to exert a torque on the load shaft during a rotation of the load shaft limited to this value of less than 360°.

11 Claims, 1 Drawing Sheet

(51) Int. Cl.
*A63B 23/12* (2006.01)
*A63B 23/035* (2006.01)

(52) U.S. Cl.
CPC ..... *A63B 23/12* (2013.01); *A63B 21/4047* (2015.10); *A63B 23/03508* (2013.01); *A63B 23/1209* (2013.01); *A63B 2220/16* (2013.01); *A63B 2220/51* (2013.01)

(58) Field of Classification Search
CPC ..... A63B 21/4033; A63B 2220/54; A63B 2220/163; A63B 23/12; A63B 23/005
See application file for complete search history.

(56) References Cited

FOREIGN PATENT DOCUMENTS

| | | | |
|---|---|---|---|
| EP | 1584355 | A2 | 10/2005 |
| FR | 2696646 | A1 | 4/1994 |
| WO | 2012/091551 | A1 | 7/2012 |

* cited by examiner

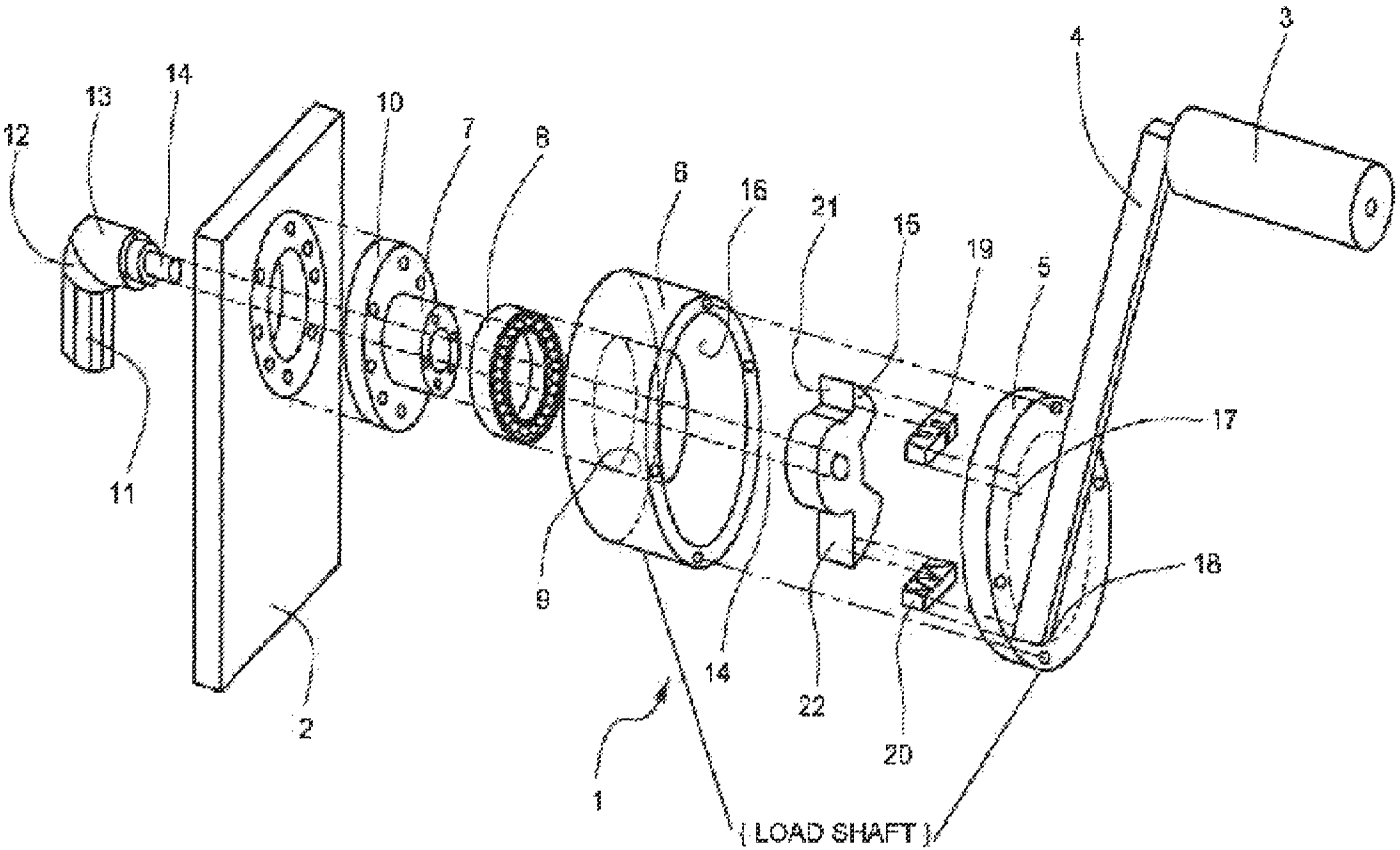
3
4
17
18
5
19
15
21
16
6
9
7
10
14
13
12
11
2
20
22
14
LOAD SHAFT
1

APPARATUS FOR PHYSICAL EXERCISE

The invention relates to a physical training apparatus, at least comprising a frame, a load which is to be gripped by a user and which is provided as a load shaft arranged on the frame and rotatable through a determined rotation angle, wherein an electric motor is provided to produce a torque exerted on the load shaft, the electric motor being coupled by means of first coupling means to a reaction shaft, which reaction shaft is coupled by means of second coupling means to the load shaft.

Apparatuses are known for controlled movement and strengthening of arm or leg or back muscles, wherein a person takes up position on a frame and then periodically displaces a load with the arms, the legs or the hack. In an apparatus for exercising the back muscles the load to be displaced by the user is for instance provided by a resistance roller which is placed against the upper part of the back and/or by a set of brackets which can be grasped adjacently of the head of the user. The load is connected via cables and pulleys to counterweights with which the load can be set to the desired magnitude.

The known training apparatuses are relatively heavy due to the presence of weights, and relatively bulky due to the presence of cables and pulleys. As a result the known apparatuses are less suitable for rapid transport and installation, for instance for brief use during periodic indoor fitness or physiotherapy sessions offered to members of staff by a company.

Known from US 2006/0234832 A1 is a training apparatus in which a torque motor actuates a load to be driven by a user by means of a handle bar. The handle bar in this known device is displaced along a linear path and is coupled to a cable trained round two reversing wheels, wherein the shaft of one of the reversing wheels is coupled to the shaft of the torque motor. The torque motor in this apparatus is adapted to produce a load when the handle bar is displaced along the linear path and to make multiple rotations during displacement of the handle bar along this path.

While a training apparatus provided with a torque motor coupled to a cable trained round two reversing wheels, wherein the shaft of one of the reversing wheels is coupled to the shaft of the torque motor, is relatively less heavy due to the absence of weights, it still remains relatively bulky due to the presence of cables and pulleys.

It is an object of the invention to provide a training apparatus which is relatively light and has little volume and which is suitable for rapid transport and installation.

It is also an object to provide a training apparatus which can be made ready in simple manner for use by a subsequent user.

A further object of the invention is to provide a training apparatus with which use by a person can foe monitored in adequate manner and, if necessary, easily adapted thereto.

These objects are achieved, and other advantages gained, with a training apparatus of the type stated in the preamble, wherein according to the invention the rotation angle of the load shaft is limited to a value of less than 360°, and the second coupling means are adapted to exert a torque on the load shaft during a rotation of the load shaft.

A training apparatus provided with an electric motor, wherein the rotations of the load shaft and the reaction shaft are limited to a value of less than 360°, is free of cables and pulleys, therefore takes up an extremely small volume and is relatively light in weight.

In an embodiment the rotation angle of the load shaft is limited to a value of less than 180°.

In an embodiment of a training apparatus according to the invention the load shaft and the reaction shaft extend coaxially or mutually in line, and the second coupling means comprise a pair of co-acting discs provided with engaging means, a first disc of which pair is coupled rigidly to the load shaft and a second disc is coupled rigidly to the reaction shaft, wherein the engaging means of the first and the second disc are adapted to cause rotation of the second disc synchronously with a rotation performed by the first disc.

In such a training apparatus the engaging means comprise for instance a pair of first earns extending from the first disc and a pair of cams extending from the second disc, wherein, a cam of the first disc is coupled by means of a first elastically deformable body to a co-acting cam of the second disc, and the other earn of the first disc is coupled by means of a second elastically deformable body to the co-acting other cars of the second disc.

In an embodiment of this training apparatus the first or second elastically deformable body comprises a force sensor, and the respective second or first elastically deformable body comprises a compression spring.

In a practically advantageous embodiment of a training apparatus according to the invention provided with co-acting discs, the load shaft is provided by a hollow cylinder which extends coaxially round the reaction shaft and is coupled to the first disc, and which is coupled at a first, end to the first disc and at a second, end is bearing-mounted, on the frame.

A training apparatus with a load shaft which extends coaxially round the reaction shaft forms an exceptionally compact whole which is easy to transport, place and remove. Because the hollow cylinder extends round the second disc coupled to the reaction shaft and tor instance comprises a force sensor coupled between the second and first discs, it is possible in simple manner to feed a cable coupled to the force sensor outward via the cylinder wall or via the end surface facing toward the frame and subsequently guide it to a control unit without the risk of damage or rapid wear as a result of normal use of the training apparatus.

In a subsequent embodiment the first coupling means comprise a right-angled transmission.

A right-angled transmission contributes toward a further reduction in the volume of a training apparatus according to the invention.

In another embodiment the first coupling means comprise a reduction gearing.

The reduction ratio of the reduction gearing has for instance a value in the range of 1:50 to 1:200.

The reduction ratio of the reduction gearing preferably amounts to 1:100, wherein a torque can be produced on the load shaft in exceptionally compact manner by an electric motor of a usual type and of a suitable power.

In an advantageous embodiment the electric motor is a servomotor.

In another embodiment angle measuring means are provided for measuring the position of the rotation angle of optionally the reaction shaft or the load shaft.

A force sensor, angle measuring means and control means are preferably provided in a training apparatus according to the invention for the purpose of controlling the rotation speed of and the power to be produced by the electric motor subject to the values measured by the force sensor and the angle measuring means in a manner such that a torque with a predetermined value is exerted on the load shaft by the reaction shaft.

The value of the torque to be exerted can for instance be predetermined as a function of the rotation position of the load shaft.

A torque to be set in such manner makes it possible for instance that, a user must exert the greatest pressure on a load when this user is in a sitting posture suitable for this purpose, for instance with back straight, and the user need exert a less great pressure when he/she is in a less suitable sitting posture, for instance with back extending forward or backward.

The invention will be elucidated hereinbelow on the basis of exemplary embodiments, with reference to the drawings.

The drawing shows an exploded view of a part 1 of a training apparatus with an upright or frame 2 and a roller 3 for gripping by the user which is arranged on the frame and which is displaceable by the user in a training movement.

The training apparatus also comprises for instance a number of components (not shown) such as a first support arranged on the frame and supporting a seat surface for a user, means for setting the position and/or orientation of the first support in a chosen stationary position, a second support for the lower back of the user, wherein the apparatus is also provided with fixation means for fixing the legs of the user relative to the first and/or second support.

The figure shows particularly the part of the training apparatus to which the invention relates.

Roller 3 is coupled by an arm 4 to a first disc 5 forming the end flange of a first hollow cylinder 6. First disc 5 and first hollow cylinder 6 together form the load shaft which is bearing-mounted on upright 2 by means of a second hollow cylinder 7 and a roller bearing 8 received in a corresponding narrow part 9 of first hollow cylinder 6. The second hollow cylinder 7 is mounted, by means of a flanged edge 10 on upright 2. On the side of upright 2 remote from load shaft a servomotor 11 with right-angled transmission 12 and a non-self-braking reduction gearing 13 is arranged fixed in second hollow cylinder 7. Servomotor 11 is of the type which can both generate and absorb power, with a unilateral load direction and two rotation directions. A reaction shaft 14 driven by motor 11 extends from reduction gearing 13 through second hollow cylinder 7 into a second disc 15 received in the wide part 16 of first hollow cylinder 6.

The first disc 5 is provided with cams 17, 18 which are coupled by means of respectively a force sensor 19 and a compression spring 20 to corresponding cams 21, 22 on second disc 15. Compression spring 20 is chosen such that the minimum load on force sensor 19 always amounts to at least 1 Nm, so that force sensor 19 and compression spring 20 always remain clapped between the respective cams 17, 21, 18, 22.

The apparatus is further provided with a Hall sensor (not shown) for measuring the rotation angle of reaction shaft 14 and cables (not shown) which connect servomotor 11, force sensor 19 and the Hall sensor to a control device (not shown).

In the shown apparatus the load shaft 5, 6 is rotatable through an angle which can be set between 90° and 140°, and the torque can be set to a value between 10 and 300 Nm. Values set by a user can for instance be stored in a computer and, during a later use by the same user, can be used for rapid setting of the apparatus to the values last set by this user. In addition to being convenient for the user, this provides continuity in his/her training schedule.

The invention claimed is:

1. A physical training apparatus comprising:

a frame;

a load shaft comprising a first disc and a hollow cylinder, wherein the load shaft is arranged on the frame and rotatable through a determined rotation angle;

a reaction shaft, coaxial with and extending into the load shaft;

a second disc coupled rigidly to the reaction shaft, wherein engagement of the first and the second disc is adapted to cause rotation of the second disc synchronously with rotation by the first disc, and an electric motor provided to produce a torque exerted on the load shaft, the motor coupled to a reaction shaft, which reaction shaft is coaxial with and extends into to the load shaft, wherein the rotation angle of the load shaft is limited to a value of less than 360degree, and the reaction shaft exert a torque on the load shaft during a rotation of the load shaft limited to this value of less than 360 degrees.

2. An apparatus as claimed in claim 1, wherein the rotation angle of the load shaft is limited to a value of less than 180°.

3. An apparatus as claimed in claim 1, further comprising a pair of first cams extending from the first disc and a pair of second cams extending from the second disc, wherein a cam of the first disc is coupled to a cam of the second disc by a first elastically deformable body, and the other cam of the first disc is coupled to the other cam of the second disc by a second elastically deformable body.

4. An apparatus as claimed in claim 3, wherein one elastically deformable body comprises a force sensor, and the other elastically deformable body comprises a compression spring.

5. An apparatus as claimed in claim 4, wherein the hollow cylinder extends coaxially around the reaction shaft and is coupled to the first disc at a first end and at a second end is bearing-mounted on the frame.

6. An apparatus as claimed in claim 1, further comprising a right-angled transmission.

7. An apparatus as claimed in claim 1, further comprising a reduction gearing.

8. An apparatus as claimed in claim 7, wherein the reduction gearing has a reduction ratio value in the range of 1:50 to 1:200.

9. An apparatus as claimed in claim 8, wherein the reduction gearing has a reduction ratio value of 1:100.

10. An apparatus as claimed in claim 1, wherein the motor is a servomotor.

11. An apparatus as claimed in claim 1, wherein the motor is configured to rotate at a speed in response to the force on and angle of the load shaft.

* * * * *